United States Patent [19]

Kreitmeier

[11] Patent Number: 4,764,968

[45] Date of Patent: Aug. 16, 1988

[54] DISK DIAPHRAGM FOR A LOUDSPEAKER

[75] Inventor: Leonhard Kreitmeier, Gunzenhausen, Fed. Rep. of Germany

[73] Assignee: Standard Elektrik Lorenz Aktiengesellschaft, Stuttgart, Fed. Rep. of Germany

[21] Appl. No.: 836,026

[22] Filed: Mar. 4, 1986

[30] Foreign Application Priority Data

Mar. 3, 1985 [DE] Fed. Rep. of Germany ..... 3507726

[51] Int. Cl.[4] ..... H04R 7/02; H04R 1/24; G10K 13/00

[52] U.S. Cl. ..... 381/204; 181/163; 381/184; 381/186; 381/202

[58] Field of Search ..... 179/181 R, 180, 115.5 R, 179/115.5 ES, 116, 178, 181 F, 115 R; 181/161, 163, 171; 381/184, 186, 194, 202, 203, 204, 182

[56] References Cited

U.S. PATENT DOCUMENTS

| | | | |
|---|---|---|---|
| 1,828,284 | 10/1931 | Hanna | 381/158 |
| 2,845,135 | 7/1958 | Cohen et al. | 381/156 |
| 3,153,463 | 10/1964 | Novak | 381/182 |
| 3,213,209 | 10/1965 | Doelitzsch | 381/186 |
| 4,122,314 | 10/1978 | Matsuda et al. | 381/193 |
| 4,173,701 | 11/1979 | Murata et al. | 181/157 |
| 4,275,278 | 6/1981 | Sakurai et al. | 381/194 |
| 4,384,174 | 5/1983 | Suzuki et al. | 381/204 |
| 4,395,597 | 6/1983 | Suzuki et al. | 381/202 |
| 4,472,604 | 9/1984 | Nakamura et al. | 381/158 |
| 4,567,327 | 1/1986 | Goosens et al. | 381/185 |
| 4,582,163 | 4/1986 | Catthoor | 381/193 |

*Primary Examiner*—Jin F. Ng
*Assistant Examiner*—Danita R. Byrd
*Attorney, Agent, or Firm*—Spencer & Frank

[57] ABSTRACT

The disklike diaphragm is made up of an essentially conical plastic film provided with vacuum-formed supporting members which extend up to the disklike radiating layer.

9 Claims, 4 Drawing Sheets

DISK DIAPHRAGM FOR A LOUDSPEAKER

BACKGROUND OF THE INVENTION

The present invention relates to a disk diaphragm for a loudspeaker having an intermediate layer between the disklike radiating layer and the voice coil.

Such a diaphragm is known from German Offenlegunschrifft DE-OS No. 29 33 425.

A loudspeaker diaphragm must meet two very important requirements: it must be light in order to be able to follow steep signal edges without delay, and it must be stiff in order to follow the signal steadily throughout its area and without being deformed.

If the first requirement is not met, the loudspeaker has a poor response to pulses and high audio frequencies. If the second requirement is not met, the electric signals are not converted into precisely corresponding, pistonlike movements of the diaphragm, but instead the latter is deformed by partial oscillations. Such deformations cause sound pressure waves which do not correspond to the electric drive signal, i.e., which reproduce the latter in distorted form. Furthermore, partial oscillation causes considerable additional stress in the diaphragm material, and can result in fatigue, and even destruction, of the diaphragm.

In order to avoid these disadvantages, it has become common practice to replace the well known and widely used conical paper diaphragm by a disk diaphragm, because the latter's radiation centers lie in one plane.

The known disk diaphragm consists of an essentially truncated-cone-shaped molded part of foamed polystyrene on whose flat front side two films are disposed one on top of the other as a disklike radiating layer.

Such a structure is rather complicated and, therefore, expensive to manufacture.

SUMMARY OF THE INVENTION

It is thus the object of the invention to design a disk diaphragm for a loudspeaker in such a manner that the diaphragm and, hence, the loudspeaker can be produced at low cost. According to the invention, the intermediate layer consists of an essentially conical plastic film provided with supporting members which extend up to the disklike radiating layer.

BRIEF DESCRIPTION OF THE DRAWINGS

In the following, the invention will now be explained in more detail with reference to the accompanying drawings, FIGS. 1 to 5, wherein.

DESCRIPTION OF THE PREFERRED EMBODIMENTS

Figure 1:
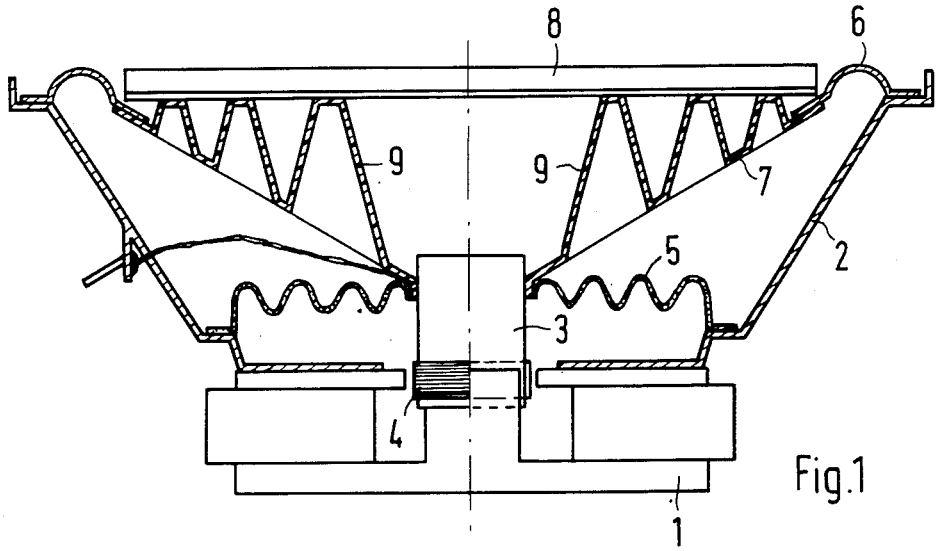
FIG. 1 is a cross-sectional view of a loudspeaker with a disk diaphragm in accordance with the invention.

As can be seen from FIG. 1, the novel disk loudspeaker includes a multitude of parts which are also contained in a loudspeaker having a cone diaphragm, i.e. the permanent magnet system 1 to which the loudspeaker basket 2 is fastened, the voice coil support 3, and the voice coil 4, the spider 5, and the crimped diaphragm suspension 6. The only two parts specific to a loudspeaker with a disk diaphragm are the conical plastic film 7, provided with supporting members 9, and the disklike radiating layer 8.

Figure 2:
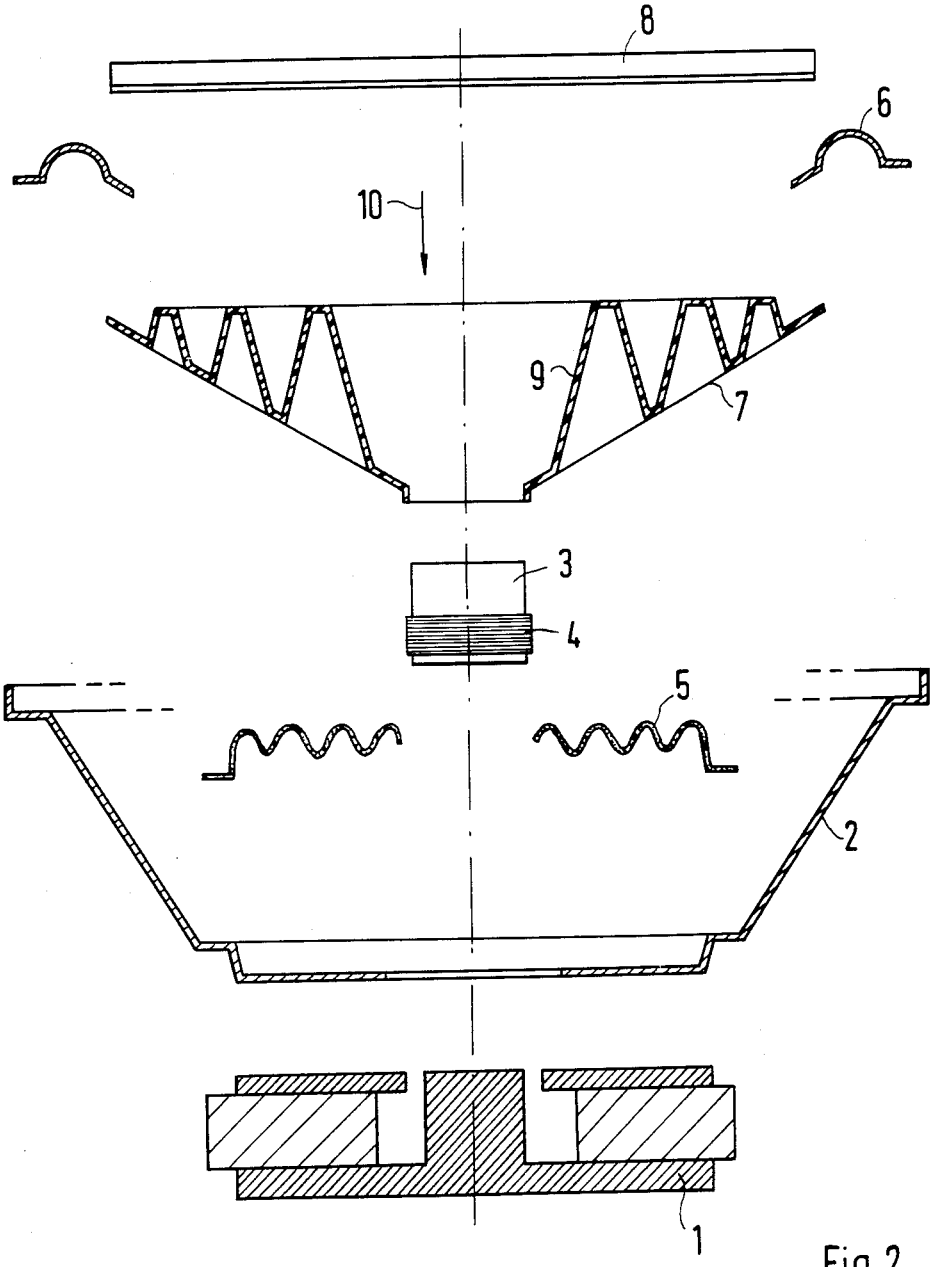
FIG. 2 is an exploded view of the loudspeaker of FIG. 1.
Figure 6:
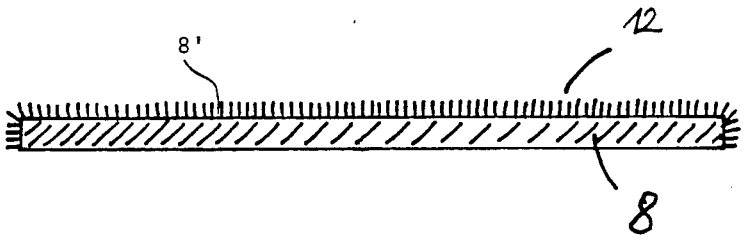
FIG. 6 shows a modification of the disklike radiating layer.

For better illustration, the individual parts of the loudspeaker are shown once again in FIG. 2 in an exploded view. The radiating layer 8 may be a circular disk of foamed polystyrene. In addition, the radiation surface 8' may be flocked with plastic fibers 12 as shown, for example in FIG. 6. By such a step, the movement of the diaphragm is damped. For special applications, the radiating layer 8 may have a multilayer structure which may consist of two outer thin metal (e.g. aluminum) sheets bonded to an intermediate layer, e.g. a layer having a honeycomb structure.

Figure 3:
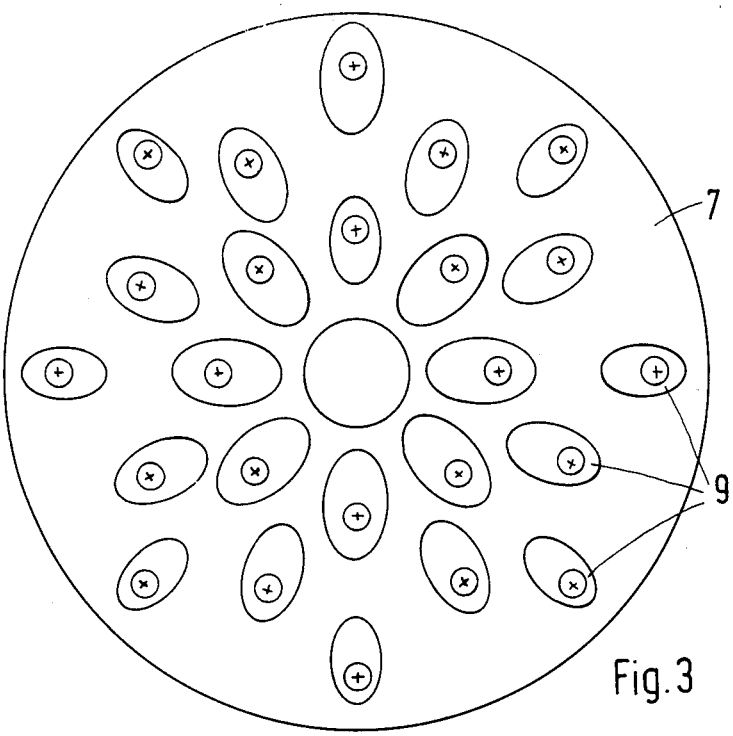
FIG. 3 shows one embodiment of the conical plastic film.
Figure 4:
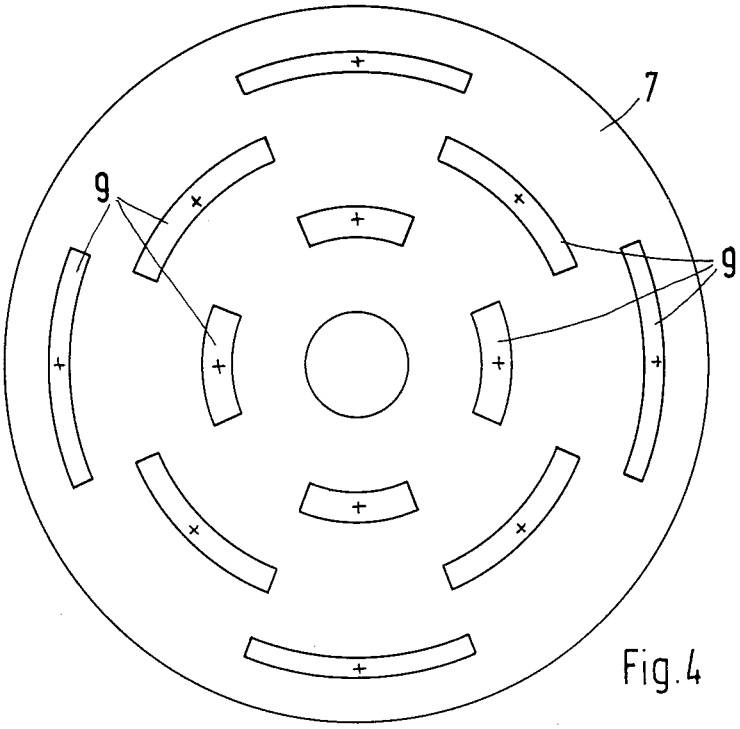
FIG. 4 shows another embodiment of the conical plastic film.

FIGS. 3 and 4 show two embodiments of the plastic film 7 provided with supporting members 9. The figures are top views of the plastic film 7 in the direction of the arrow 10 in accordance with FIG. 2. The plastic film provided with the supporting members 9 may also be a conventional plastic cone diaphragm, to which the supporting members 9 are attached, for example glued. However, such a construction is likely to be too costly. It should therefore be more advantageous to manufacture the supporting elements 9 and the plastic film 7 as a single piece. This can be done e.g. by vacuum-forming the two parts simultaneously.

In the embodiment illustrated in FIG. 3, the supporting members 9 have a truncated-cone shape which tapers off towards the radiating layer.

In the embodiment illustrated in FIG. 4, the supporting members 9 have the form of circular segments.

Figure 5:
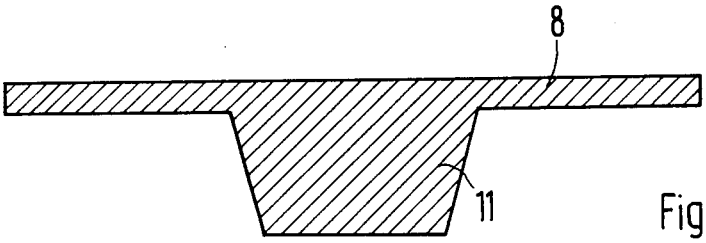
FIG. 5 shows another embodiment of the disklike radiating layer.

FIG. 5 shows another embodiment of the radiating layer 8, which differs from the above embodiment in that its reverse side is provided with a symmetrical projecting portion 11. If this projecting portion 11 has the proper dimensions, the radiating layer 8 can be centered in a simple manner.

What is claimed is:

1. A disk diaphragm for a loudspeaker comprising a disklike radiating layer having a disklike radiation surface and an intermediate layer situated so as to be disposed between the surface of said disklike radiating layer opposite said radiation surface and a voice coil of a loudspeaker, and wherein the intermediate layer comprises an essentially conical plastic film provided with a plurality of discrete spatially limited supporting members, with each said member extending from the inner surface of said essentially conical plastic film up to said opposite surface of the disklike radiating layer, and being connected to said inner surface.

2. A diaphragm as claimed in claim 1, wherein each of the supporting members is shaped like a truncated cone.

3. A diaphragm as claimed in claim 1, wherein each of the supporting members has the form of a circular segment.

4. A diaphragm as claimed in claim 1, wherein the disklike radiating layer is a circular disk of foamed polystyrene.

5. A diaphragm as claimed in claim 4, wherein the radiation surface of the disklike radiating layer is flocked with plastic fibers.

6. A diaphragm as claimed in claim 4, wherein said surface of the disklike radiating layer which is opposite to the radiation surface has a symmetrical projecting portion.

7. A diaphragm as claimed in claim 1 wherein the disklike radiating layer has a sandwich structure consisting of two outer layers in the form of thin metal sheets and an intermediate layer with a honeycomb structure.

8. In a loudspeaker including a voice coil and a disk diaphragm comprising a disklike radiating layer and an intermediate layer situated between said disklike layer and said voice coil; the improvement wherein said intermediate layer comprises an essentially conical plastic film provided with a plurality of discrete spatially limited supporting members, with each said member extending from the inner surface of said essentially conical plastic film to said disklike radiating layer and being fastened to said inner surface.

9. A disk diaphragm for a loudspeaker comprising: a disk shaped layer having first and second opposite surfaces with said first surface being a disk shaped radiating surface; and an essentially conical plastic film having a plurality of discrete spatially limited supporting members, each of which extends from and is connected to the inner surface of said film and is fastened to said second surface of said disk shaped layer.

* * * * *